US006733859B2

(12) United States Patent
Yoneda et al.

(10) Patent No.: US 6,733,859 B2
(45) Date of Patent: May 11, 2004

(54) NAPPED LEATHER-LIKE SHEET MATERIAL AND METHOD OF PRODUCING SAME

(75) Inventors: Hisao Yoneda, Okayama (JP); Yoshiki Nobuto, Okayama (JP); Norio Makiyama, Kurashiki (JP)

(73) Assignee: Kuraray Co., Ltd., Kurashiki (JP)

( * ) Notice: Subject to any disclaimer, the term of this patent is extended or adjusted under 35 U.S.C. 154(b) by 138 days.

(21) Appl. No.: 09/991,642

(22) Filed: Nov. 26, 2001

(65) Prior Publication Data

US 2002/0114919 A1 Aug. 22, 2002

(30) Foreign Application Priority Data

Nov. 24, 2000 (JP) ..... 2000-357597

(51) Int. Cl.[7] ..... B32B 3/02; B32B 5/22; B32B 9/02; B05D 1/34; B05D 1/36

(52) U.S. Cl. ..... 428/91; 428/904; 442/71; 442/72; 442/74; 442/102; 427/389.9; 427/412

(58) Field of Search ..... 427/389.9, 412, 427/421; 428/91, 904; 442/71, 72, 74, 97, 102, 104, 118, 76

(56) References Cited

U.S. PATENT DOCUMENTS 6,451,404 B1 9/2002 Nobuto et al.

FOREIGN PATENT DOCUMENTS

| | | | | | |
|---|---|---|---|---|---|
| JP | 03045784 | A | * | 2/1991 | ..... D06N/3/00 |
| JP | 03045785 | A | * | 2/1991 | ..... D06N/3/00 |
| JP | 04300369 | A | * | 10/1992 | ..... D06N/3/14 |
| JP | 5-78979 | | | 3/1993 | |
| JP | 05093373 | A | * | 4/1993 | ..... D06N/7/00 |
| JP | 05247855 | A | * | 9/1993 | ..... D06N/3/00 |
| JP | 6-316871 | | | 11/1994 | |
| JP | 2000044598 | A | * | 2/2001 | ..... C07K/14/435 |
| JP | 2001089977 | A | * | 4/2001 | ..... D06N/3/14 |
| WO | WO 9428056 | A1 | * | 12/1994 | ..... C08J/5/18 |

* cited by examiner

*Primary Examiner*—Cheryl A. Juska
(74) *Attorney, Agent, or Firm*—Oblon, Spivak, McClelland, Maier & Neustadt, P.C.

(57) ABSTRACT

A napped leather-like sheet material comprising an entangled nonwoven fabric composed of ultrafine fibers and an elastomer contained therein and having a nap made of ultrafine fibers on one or both sides thereof, which material is provided with a silk protein substance and a softening agent on the surface portion of the napped face or faces; and a method of producing the above napped leather-like sheet material which comprises applying a liquid containing a silk protein substance and a softening agent to the surface of a napped leather-like sheet material by, for example, a gravure printing or spraying technique.

20 Claims, No Drawings

NAPPED LEATHER-LIKE SHEET MATERIAL AND METHOD OF PRODUCING SAME

BACKGROUND OF THE INVENTION

1. Field of the Invention

This invention relates to a napped leather-like sheet material with a nap having a good feel and touch and to a method of producing the same. More particularly, the invention relates to a leather-like, i.e., artificial leather, sheet material having a natural leather suede-like or nubuck-like velvety, smooth surface touch, an appropriate extent of flexibility with reduced firmness and a good feel or touch and giving a sensation of being of high quality, and to a method of producing the same.

2. Description of the Prior Art

With leather-like sheet materials having a napped surface (napped leather-like sheet materials), the feel and touch thereof largely depends on the sensation felt upon touching the surface. A number of proposals have so far been made for improving the surface touch of napped leather-like sheet materials. As typical of such prior art technology, there may be mentioned, among others, (1) the method of adding a wet touch to napped leather-like sheet materials which comprises providing the same with a softening agent and (2) the method of adding a dry touch to napped leather-like sheet materials which comprises providing the same with a silicone resin. These methods (1) and (2) have been widely employed in the industry as methods of improving the surface touch of napped leather-like sheet materials.

The above prior art methods (1) and (2) can indeed improve the surface touch to a certain extent but not yet to a fully satisfactory extent. Thus, no napped leather-like sheet materials having a natural leather suede-like or nubuck-like velvety, smooth surface touch, excellent in flexibility with reduced firmness, and having a feel or touch suggestive of being of high quality have been obtained as yet.

In a field other than that of leather-like sheet materials, a proposal has been made to produce cloths having a silk-like dry touch by providing the cloths with a natural silk protein or the like (e.g. Japanese Unexamined Patent Applications laid open under Nos. Kokai H05-78979 and Kokai H06-316871).

Accordingly, the present inventors made experiments to apply this method to napped leather-like sheet materials. Although an increased coating weight of a silk protein provided a silk-like touch to napped leather-like sheet materials, any napped leather-like sheet materials having a natural leather suede-like or nubuck-like velvety touch, excellent in flexibility with reduced firmness, and having a surface touch giving a sensation of being of high quality could not be obtained.

SUMMARY OF THE INVENTION

It is an object of this invention to provide a napped leather-like sheet material having a natural leather suede-like or nubuck-like feel or touch, namely a velvety, smooth surface touch, as well as flexibility with reduced firmness and excellent in feel and touch and giving a quality sensation, without impairing the mechanical characteristics, such as tensile tenacity, which are intrinsic in napped leather-like sheet materials, and a method of producing the same. Thus, the invention is a napped leather-like sheet material provided with (1) at least one silk protein substance selected from among silk proteins and partial hydrolyzates of silk proteins, and (2) a softening agent, on the napped surface on one or both sides.

The invention is also a method of producing napped leather-like sheet materials which comprises applying a solution containing at least one silk protein substance selected from among silk proteins and partial hydrolyzates of silk proteins and a softening agent, or applying a solution containing such silk protein substance and a solution containing a softening agent simultaneously or one by one, i.e., separately, to the napped surface of a napped leather-like sheet material composed of an entangled nonwoven fabric made of ultrafine filaments or fibers and an elastomeric polymer, or elastomer, contained in the nonwoven fabric, and having a nap made of ultrafine fibers raised on one or both sides.

DETAILED DESCRIPTION OF THE INVENTION

The napped leather-like sheet material according to the invention is based on a napped leather-like sheet material composed of an entangled nonwoven fabric made of ultrafine fibers and an elastomer contained therein and having a nap made of ultrafine fibers raised on one or both sides.

Referring to the napped leather-like sheet material, the fineness of the ultrafine fibers constituting the napped leather-like sheet material is not particularly restricted but, generally, it is preferred that both the ground structure (entangled nonwoven fabric portion) and the nap be formed of ultrafine fibers with a fineness of 0.0001 to 0.5 decitex, preferably 0.0001 to 0.1 decitex. When the fineness of the ultrafine fibers, in particular the fineness of the ultrafine fibers forming the nap, is in excess of 0.5 decitex, the surface touch can hardly be rendered natural leather suede-like or nubuck-like. On the other hand, if the fineness of the ultrafine fibers is less than 0.0001 decitex, the dyeability will be lower and the color tone tends to become poor.

The ultrafine fibers may be made of any of fiber-forming polymers, for example aromatic ring-containing polyesters such as polyethylene terephthalate, polypropylene terephthalate and polybutylene terephthalate; polyamides such as nylon-6, nylon-66, nylon-12, nylon-610, and copolymers thereof; and polyolefins such as polyethylene and polypropylene. Among them, ultrafine fibers formed of a polyester and/or a polyamide, in particular a polyamide, are preferred from the viewpoint of strength, of feel and touch and/or of dyeability, for instance.

In the napped leather-like sheet material, the ultrafine fibers mentioned above are in an entangled state to form an entangled nonwoven fabric, and an elastomer is contained in the interfibrous spaces in the entangled nonwoven fabric.

The elastomer to be contained in the entangled nonwoven fabric may be any of those known high-molecular elastomers. Thus, mention may be made of natural rubbers, SBR, NBR, polychloroprene, polyisoprene, chlorosulfonylated polyethylene, polyisobutylene, isobutylene-isoprene rubbers, acrylic rubbers, polyurethane elastomers, polyester-based thermoplastic elastomers, polyamide-based thermoplastic elastomers, polystyrene-based thermoplastic elastomers, polyolefin-based thermoplastic elastomers, polydiene-based thermoplastic elastomers, chlorinated thermoplastic elastomers and the like, and these can be used either singly or in combination of two or more.

Among them, polyurethane elastomers (elastic polyurethane resins) are preferably used from the viewpoint of the feel and touch, dyeability, wear resistance, tensile strength and other mechanical characteristics of napped leather-like sheet materials, for instance.

Those polyurethane resins which have elasticity can all be used as the polyurethane elastomers. Particularly preferred, however, are segmented polyurethanes producible by using a polymer diol having a number average molecular weight of 500 to 5,000 as a soft segment component and an organic diisocyanate as a hard segment component and reacting these components with each other together with a low-molecular weight chain extender.

The above polymer diol to be used in the production of segmented polyurethanes includes, among others, polyester diols obtainable by reacting a dicarboxylic acid component with a diol component, polylactone diols, polycarbonate diols, polyester polycarbonate diols and polyether diols. One or two or more of these polymer diols can be used. When a polymer diol having a number average molecular weight of less than 500 is used in producing segmented polyurethanes, the soft segment becomes too short and the resulting polyurethanes will lack flexibility; hence it may become difficult to obtain natural leather-like napped sheet materials. If, conversely, the number average molecular weight of the polymer diol exceeds 5,000, the proportion of urethane bonds in the polyurethane relatively decreases, resulting in decreases in durability, heat resistance, hydrolysis resistance, etc.; hence, napped leather-like sheet materials having practical physical properties can hardly be obtained.

The organic diisocyanate to be used in producing segmented polyurethanes may be any of those organic diisocyanates so far used in the art in producing polyurethanes. Thus, mention may be made of, for example, aromatic diisocyanates such as 4,4'-diphenylmethanediisocyanate, tolylene diisocyanate, phenylene diisocyanate, xylylene diisocyanate, isophoronediisocyanate and 1,5-naphthylene diisocyanate; aliphatic diisocyanates such as hexamethylene diisocyanate; and alicyclic diisocyanates such as 4,4'-dicyclohexylmethanediisocyanate and hydrogenated xylylene diisocyanate. One or two or more of the above organic diisocyanates can be used.

The low-molecular weight chain extender to be used in producing segmented polyurethanes may be any of those low molecular chain extenders so far used in producing polyurethanes, in particular low-molecular weight chain extenders having a molecular weight of not more than 400. Thus, mention may be made of, for example, diols such as ethylene glycol, propylene glycol, 1,4-butanediol, 1,6-hexanediol, 3-methyl-1,5-pentanediol, neopentyl glycol, N-methyldiethanolamine, 1,4-cyclohexanediol, bis(β-hydroxyethyl) terephthalate, xylylene glycol and 1,4-bis(β-hydroxyethoxy)benzene; diamines such as hydrazine, ethylenediamine, propylenediamine, isophoronediamine, piperazine and derivatives thereof, phenylenediamine, tolylenediamine, xylylenediamine, adipic acid dihydrazide, isophthalic acid dihydrazide, hexamethylenediamine, 4,4'-diaminodiphenylmethane and 4,4'-dicylohexylmethanediamine; and amino alcohols such as aminoethyl alcohol and aminopropyl alcohol. One or two or more of these low-molecular weight chain extenders can be used.

In producing the segmented polyurethanes, the above polymer diol, organic diisocyanate and low-molecular weight chain extender are subjected to reaction preferably in an equivalent ratio such that the ratio [total isocyanato groups]/[total functional groups reactive with the isocyanato group, such as hydroxyl and amino] be within the range of 0.9 to 1.1, since, then, napped leather-like sheet materials having a high tearing strength can be obtained.

For improving the solvent resistance, heat resistance and hot water resistance of the polyurethane, the polyurethane may be caused to have a crosslinked structure therein by reacting therewith an at least trifunctional polyol, such as trimethylolpropane, an at least trifunctional amine or the like according to need.

In view of the possibility of attaining a natural leather-like flexible touch, the ratio by mass between the fibrous component constituting the entangled nonwoven fabric or the like and elastomer in the napped leather-like sheet material of the invention is preferably within the range of 30:70 to 95:5, more preferably 40:60 to 85:15. If the proportion of the fibrous component is less than 30% by mass based on the mass of the napped leather-like sheet material, a rubber-like feel and touch will readily result. Conversely, if the proportion of the fibrous component exceeds 95% by mass based on the mass of the napped leather-like sheet material, the falling of ultrafine fibers tends to occur and the pilling resistance tends to decrease, for instance.

A nap can be raised on one side or both sides of the leather-like sheet material by subjecting one or both surfaces of the leather-like sheet material to be napped to napping treatment, which comprises buffing with a sandpaper or the like or nap raising by means of wire clothing, whereby part of the ultrafine fibers constituting the entangled nonwoven fabric is raised as a nap.

The nap height or length or nap density of the napped portion is not particularly restricted but may be adjusted according to the intended use of the napped leather-like sheet material. Generally, a mean nap length of 0.05 to 2 mm and a nap density of 10,000 to 300,000 fibers/cm$^2$ are preferred. If a nap length is less than 0.05 mm, it is difficult to attain a satisfactory writing effect or suede-like appearance. If it exceeds 2 mm, pilling will readily occur during use. If the nap density is less than 10,000 fibers, the natural leather suede-like favorable appearance will hardly be obtained and, further, the surface touch tends to be poor in nubuck-like velvetiness and smoothness. A density higher than 300,000 fibers is excessive and the writing effect tends to decrease.

In the napped leather-like sheet material of the invention, the ultrafine fibers and elastomer are preferably in a state such that they are substantially free from mutual adhesion. Owing to the fact that the ultrafine fibers are not adhering to the elastomer, the ultrafine fibers are not restrained by the elastomer but have an increased degree of freedom to move, whereby a natural leather-like soft and flexible feel or touch can be obtained.

The method of producing the napped leather-like sheet material, which serves as the base, is not particularly restricted. The sheet can be produced using any of the methods known in the art, for example the methods (i) to (iii) mentioned below.

(i) The method which comprises producing an entangled nonwoven fabric using ultrafine fiber-generating fibers obtained by spinning at least two fiber-forming polymers differing in solubility or decomposability by the mixed spinning method, sea-island type composite spinning method, splitting type composite spinning method or like method, impregnating the nonwoven fabric with an elastomer and, after coagulation of the elastomer, removing at least one polymer component from the ultrafine fiber-generating fibers to produce ultrafine fibers or splitting the ultrafine fiber-generating fibers to produce ultrafine fibers, followed by napping treatment.

(ii) The method which comprises producing an entangled nonwoven fabric using the above ultrafine fiber-generating fibers, removing at least one polymer component from the ultrafine fiber-generating fibers or splitting the ultrafine fiber-generating fibers to produce ultrafine fibers, impregnating the resulting nonwoven fabric with an elastomer and, after coagulating the elastomer, subjecting the nonwoven fabric to napping treatment.

(iii) The method which comprises producing an entangled nonwoven fabric using ultrafine fibers directly obtained by the melt blow method or the like, then impregnating the same with an elastomer and, after coagulating the elastomer, subjecting the nonwoven fabric to napping treatment.

In the ultrafine fiber-generating fibers to be used in the above-mentioned method (i) or (ii), the fiber-forming polymer component which is to remain as ultrafine fibers includes, as mentioned hereinabove, aromatic ring-containing polyesters such as polyethylene terephthalate, polypropylene terephthalate and polybutylene terephthalate; polyamides such as nylon-6, nylon-66, nylon-12 and nylon-610, and copolymers thereof; polyolefins such as polyethylene and polypropylene; acrylics and so forth. In the above ultrafine fiber-generating fibers, the polymer component to be removed by dissolution or by decomposition includes, among others, polyethylene, polypropylene, ethylene-propylene copolymers, ethylene-vinyl acetate copolymers, polystyrene, styrene-acrylic monomer copolymers, styrene-ethylene copolymers and the like.

The ultrafine fibers to be used in the above method (iii) can be produced by using, for example, such polyesters, polyamides and polyolefins as mentioned above.

In cases where the napped leather-like sheet material is produced by the above method (i), the sheet can be produced more specifically in the following manner.

(a) The ultrafine fiber-generating fibers are stretched, cut and made into webs by the wet papermaking method known in the art, or the ultrafine fiber-generating fibers are rendered cotton-like in form by such treatments as stretching, crimping and cutting, and the cotton-like fibers are then opened on a card and made into webs on a random webber or cross-lap webber. The wet papermaking method is preferably used when the cut length is 1 to 20 mm, while it tends to worsen the dispersibility of ultrafine fiber-generating fibers when the cut length is longer than 20 mm. Therefore, the method comprising opening on a card, followed by web formation on a random webber or cross-lap webber is preferably used. Where necessary, the webs are overlaid with each other or one another to give a desired basis weight. Generally, the basis weight of the final web is preferably 100 to 3,000 g/m$^2$, although it may vary according to the intended use of the napped leather-like sheet material, for instance.

(b) Then, an entangled nonwoven fabric is produced by entangling treatment using a method known in the art, such as the needle punching method or high-pressure water jet method. Generally, the number of punches in the needle punching is preferably 200 to 2,500 punches/cm$^2$, although it may vary according to the needle geometry and/or web thickness and/or other factors. For adjusting the tensile tenacity of the napped leather-like sheet material, for adjusting the basis weight and/or thickness and for other purposes, a woven or knit fabric, a nonwoven fabric made of different fibers, film or like sheet material may also be integrated with the entangled nonwoven fabric by lamination, in any stage after web formation to completion of entanglement treatment. It is also possible to use a melt-blown nonwoven fabric formed by the direct melt blow method or a spunbonded nonwoven fabric as the entangled nonwoven fabric.

(c) Then, the entangled nonwoven fabric obtained in the above manner mentioned under (b) is caused to contain an elastomer. The method of providing the elastomer is not particularly restricted but, from the viewpoint of balanced feel and touch, the method comprising impregnating the entangled nonwoven fabric with an elastomer solution or dispersion and then coagulating (solidifying) the elastomer by the wet or dry technique is preferably employed. A coloring material such as a pigment or dye, a coagulation modifier, a flammability modifier and/or like additives can be added to the elastomer solution or dispersion according to need.

(d) The elastomer-impregnated entangled nonwoven fabric is then treated with a liquid capable of acting as a dissolving or decomposing agent selectively against one component or a plurality of components in the ultrafine fiber-generating fibers for converting the ultrafine fiber-generating fibers to ultrafine fiber bundles to give a sheet-like material composed of the ultrafine fiber bundle-made entangled nonwoven fabric and the elastomer contained therein.

(e) Then, the sheet-like material obtained as mentioned above under (d) is cut (sliced) into a plurality of slices in the direction of thickness according to need. One or both sides of each sheet or slice are napped by napping treatment such as buffing with a sandpaper or the like or nap raising on wire clothing, for instance.

In the case of the above-mentioned method (i) which comprises the above series of steps (a) to (e), in particular when sea-island structure fibers are used as the ultrafine fiber-generating fibers and the island component is allowed to remain as ultrafine fibers, a structure is obtained in which the ultrafine fibers (bundles) and the elastomer are not in a state substantially bonded together. Thus, the ultrafine fiber bundles are not strained by the elastomer but have an increased degree of freedom to move within the structure and, therefore, it is possible to obtain a napped leather-like sheet material excellent in natural leather-like flexibility.

In the case of the above-mentioned method (iii) which comprises producing an entangled nonwoven fabric using fibers rendered ultrafine in advance and causing the same to contain an elastomer, too, the entangled nonwoven fabric production, the impregnation of the entangled nonwoven fabric with the elastomer and the napping treatment can be carried out in the same manner as in the above method (i). In practicing the above method (ii) or (iii), the ultrafine fiber-made entangled nonwoven fabric is provided with a water-soluble resin prior to impregnation of the entangled nonwoven fabric with the elastomer and coagulation of the same and then, after elastomer impregnation and coagulation, the water-soluble resin is removed by dissolution in water. The adhesion of the ultrafine fibers to the elastomer is thereby prevented or reduced and the degree of freedom of the ultrafine fibers to move is increased, so that a napped leather-like sheet material with improved flexibility can be obtained. In the above method (i) as well, the technique comprising providing the entangled nonwoven fabric with a water-soluble resin prior to elastomer impregnation and coagulation and removing the water-soluble resin by dissolution in water after elastomer impregnation and coagulation can be used, whereby the resulting napped leather-like sheet material can have much more improved flexibility.

Generally, from the viewpoint of feel and touch and/or tenacity, the thickness of the napped leather-like sheet material is preferably about 0.2 to 4 mm, more preferably about 0.3 to 2 mm, inclusive of the napped portion, although the thickness may appropriately be selected according to the intended use and other factors.

For obtaining soft and flexible feel or touch and appropriate firmness and resilience, the basis weight of the napped leather-like sheet material is preferably 50 to 1,000 g/m$^2$, more preferably 100 to 800 g/m$^2$.

The napped leather-like sheet material is dyed, if necessary. The dye and dyeing apparatus and dyeing and other conditions are not particularly restricted but can appropriately be selected from those known in the art according to the ultrafine fiber species, the elastomer species, the intended use of the napped leather-like sheet material, etc. When the ultrafine fiber constituting the entangled nonwoven fabric are mainly nylon fibers, for instance, the sheet can be dyed using an acid dye and carrying out the dyeing treatment in a circular dyeing machine at a water temperature of 90 to 150° C. for 1 to 2 hours.

If necessary, such a treatment as the trimming treatment generally applied to napped leather-like sheet materials to put the napped state in order may be carried out combinedly.

The napped leather-like sheet material of the present invention is derived from the above-mentioned napped leather-like sheet material by providing the napped surface portion thereof with a silk protein substance and a softening agent. The napped leather-like sheet material of the invention thereby acquires a feel or touch indicative of its high quality feature, inclusive of a natural leather suede-like or nubuck-like smooth and velvety feel, flexibility with reduced firmness, and a good surface touch.

In cases where the napped leather-like sheet material of the invention has a nap on both sides, either the surface portion of one napped face or the surface portions of both napped faces may be provided with the silk protein substance and softening agent. It is preferred, however, that the surface portions of both napped faces be provided with them. In cases where the napped leather-like sheet material of the invention has a nap on one side alone and the other side is an unnapped surface, for example a grain, either the surface portion of the napped face or the surface portions of both napped and unnapped faces may be provided with the silk protein substance and softening agent.

The napped leather-like sheet material of the invention is provided with the silk protein substance and softening agent preferably in the surface portion inclusive of at least the napped portion and a shallow portion just below the napped portion, with the portion not provided therewith occurring as a layer in the direction of thickness of the napped leather-like sheet material.

When both surface portions of the napped leather-like sheet material are provided with the silk protein substance and softening agent, it is preferred that at least the napped portion and a shallow surface portion just below the napped portion of each side be provided therewith and the portion not provided therewith occur as a layer in the vicinity of the middle in the direction of thickness of the napped leather-like sheet material.

When such surface portion(s) as mentioned above on the napped face(s) is (are) provided with the silk protein substance and softening agent and the portion not provided therewith occurs as a layer in the vicinity of the middle, for instance, in the direction of thickness, the napped leather-like sheet material is appropriately provided with the above-mentioned natural leather suede-like or nubuck-like quality surface touch and flexibility, without impairing the mechanical characteristics, such as tensile tenacity, which are intrinsic in napped leather-like sheet materials.

As the method of selectively providing the surface portion of the napped face of the napped leather-like sheet material with the silk protein substance and softening agent, the method of application by the gravure printing, spraying or like technique is preferably employed, as mentioned above.

When not only the surface portion of the napped face but also the inside of the napped leather-like sheet material using dipping method or the like, in particular even the middle portion of the thickness, is provided with the silk protein substance and softening agent, the above-mentioned natural leather suede-like or nubuck-like quality surface touch and flexibility can indeed be provided. However, the fibers constituting the entangled nonwoven fabric tend to be readily disentangled and the mechanical characteristics, such as breaking strength, tend to decrease.

Any of silk-derived water-soluble or water-insoluble proteins or partial hydrolyzates thereof can be used as the silk protein substance to be given to the napped leather-like sheet material. As specific examples, there may be mentioned silk fibroin solubilized in water, water-soluble partial hydrolyzates of silk fibroin, water-insoluble silk powders prepared by mechanically comminuting silk fibers, and the like. In the case of silk powders, however, when the coating weight per unit area is increased, the condition of the white minute silk powder adhering to the napped leather-like sheet material becomes noticeable and the napped leather-like sheet material tends to appear whitened. Therefore, silk fibroin solubilized in water and/or water-soluble partial hydrolyzates of silk fibroin are preferably used as the silk protein substance, and water-soluble partial hydrolyzates of silk fibroin are more preferably used.

As the silk fibroin solubilized in water, there may be mentioned, for example, solutions of silk fibroin as dissolved in aqueous solutions of calcium chloride, calcium nitrate, lithium bromide, dichloroacetic acid and/or the like. As the water-soluble partial hydrolyzates of silk fibroin, there may be mentioned, for example, products of partial hydrolysis of the above-mentioned silk fibroin using an enzyme (protease), and products of partial hydrolysis of the same using an alkali such as sodium hydroxide or an acid such as sulfuric acid, followed by neutralization. In particular, those water-soluble partial hydrolyzates of silk fibroin which have a mean molecular weight within the range of 100 to 10,000, preferably 500 to 3,000, are preferably used from the viewpoint of touch and/or workability.

The softening agent with which the napped leather-like sheet material is to be provided can appropriately be selected from among various softening agents in general use in the textile-related field of industry taking into consideration the compatibility with the ultrafine fibers and elastomer constituting the napped leather-like sheet material, the softening effect and so forth. According to a finding made by the inventors, those softening agents capable of producing a softening effect confirmable by at least 30 out of 50 testers in evaluating the "feel and touch" of a cloth uniformly provided with the softening agent in question in an amount of 5% by mass synthetically based on the "firmness", "velvety, smooth and soft feeling (numeri in Japanese)" and "bulkiness" thereof after provision of the softening agent as compared with those before provision. The feature "firmness" so referred to herein is defined as the "substantial sensation of flexibility, resilience and elasticity as felt upon touching, for example the sensation of a cloth constituted of elastic fibers or yams and having an appropriately high yam density". The "velvety, smooth and soft feeling (numeri)" is defined as the "mixed sensation of smoothness, pliability and softness as brought about by fine and soft wool fibers, for example the sensation obtained from cashmere, and, in technical terms, the softness resulting from the good quality of wool or the like". The "bulkiness" is defined as the "sensation of a bulky, mellow, plump cloth, for example the sensation of resilience upon compression and of thickness accompanied by warmth". And, the softening agent includes, among others, various silicone type softening agents, such as alkylsilicones, amino-modified silicones, amide-modified silicones and epoxy-modified silicones, amide type softening agents, such as polyamides and fatty acid amides, and polyhydric alcohol type softening agents. One or two or more of these can be used. Among them, silicone type softening agents and/or polyamide type softening agents, in particular polyamide type softening agents, are preferably used in the practice of the invention in view of the softening effect relative to the amount applied (coating weight) and of the workability, among others. Preferred specific examples of such softening agents are alkylsilicone type softening agents such as "DIC Silicone Softener 120" (trade name; product by Dainippon Ink & Chemicals, Inc.), amino-modified silicone type softening agents such as "Nicca Silicone AM-204" (trade name; product by NICCA CHEMICAL CO., LTD.), and polyamide type softening agents such as "Racset K-150" (trade name; product by Rakuto Kasei Industrial Co., Ltd.).

The ratio by mass between the silk protein substance and softening agent to be applied to the napped leather-like sheet material is preferably within the range of 20:80 to 70:30, more preferably 30:70 to 60:40, from the viewpoint of balanced feel and surface touch, etc. When the proportion of the silk protein substance applied is less than 20% by mass based on the total amount of the silk protein substance and softening substance applied, it becomes difficult to obtain the natural leather suede-like or nubuck-like velvety and smooth feel and touch; a strongly sticky touch typical of softening agent treatment tends to result. Conversely, if the amount of the silk protein substance applied exceeds 70% by mass based on the total amount of the silk protein substance and softening agent applied, the touch will become a dry one and the natural leather suede-like or nubuck-like velvety and smooth feel and touch will hardly be obtained.

The amounts of the silk protein substance and softening agent to be given to the napped leather-like sheet material can be adjusted according to the particular silk protein substance and/or softening agent employed and the intended use of the napped leather-like sheet material, among others. Generally, from the viewpoint of balanced effects, productivity, and/or mechanical characteristics of the napped leather-like sheet material, among others, it is preferred that, based on the basis weight (A) ($g/m^2$) of the napped leather-like sheet material before being provided with the silk protein substance and softening agent, the amount of the silk protein substance applied be 0.05 to 2.5% [0.0005 A to 0.025 A ($g/m^2$)], more preferably 0.08 to 1.5% [0.0008 A to 0.015 A ($g/m^2$)], and the amount of the softening agent applied be 0.1 to 10% [0.001 A to 0.10 A ($g/m^2$)], more preferably 0.13 to 8% [0.0013 A to 0.08 A ($g/m^2$)].

As for the form of the silk protein substance and of the softening agent in providing the napped leather-like sheet material therewith and the method of providing the napped leather-like sheet material therewith, there may be mentioned the method comprising applying a mixture containing both the silk protein substance and softening agent to the sheet material, and the method comprising preparing a silk protein substance-containing liquid and a softening agent-containing liquid, respectively, and applying these liquids simultaneously or one by one, i.e., separately, to the sheet material. Among them, the method comprising applying a mixture containing both the silk protein substance and softening agent is preferred from the viewpoint of process simplification, among others. On that occasion, the mixture may take the form of a solution, dispersion or paste, for instance. The solution or dispersion form is preferred, however.

The napped leather-like sheet material of the invention as obtained in the above manner can judiciously be used in various fields of use where it comes into contact with the human skin, such as clothing, gloves, cushion seats, bags, footwear and car interiors, making the best use of its excellent surface touch and flexibility and its feel and touch suggestive of its being of high quality.

In the following, the present invention is described more specifically by giving typical examples and comparative and reference examples. The following examples are, however, by no means limitative of the scope of the invention. In the examples, "part(s)" and "%" are "part(s) by mass" and "% by mass", respectively, unless otherwise specified.

The napped leather-like sheet materials obtained in the following examples were measured for breaking tenacity and tearing strength and evaluated for surface touch and flexibility by the methods mentioned below.

(1) Breaking tenacity and tearing strength of each napped leather-like sheet material:

Measurements were made according to JIS L 1096.

(2) Surface touch of each napped leather-like sheet material:

Ten (10) testers engaged in the manufacture and sale of artificial leather products touched the surface of each napped leather-like sheet material with the hand and evaluated the surface touch thereof according to the criteria given below. The evaluation result given by the largest number of testers was reported.

[Surface Touch Evaluation Criteria]

○: Natural leather suede-like velvety and smooth touch.

Δ: More or less natural leather suede-like smoothness, yet unsatisfactory.

X: No natural leather suede-like smoothness.

(3) Flexibility of each napped leather-like sheet material:

Ten (10) testers engaged in the manufacture and sale of artificial leather products took hold of the napped leather-like sheet material by the hand and evaluated the flexibility thereof according to the criteria given below. The evaluation result given by the largest number of testers was reported.

[Flexibility Evaluation Criteria]

○: Having flexibility, with appropriately reduced firmness, rendering the material suited for use in making clothes etc.

Δ: Flexibility insufficient for use in making clothes etc.

X: Firm and lacking in flexibility for use in making clothes etc.

EXAMPLE 1

[Example of Production of a Napped Leather-like Sheet Material] (Prior Art Example)

(1) Chips of nylon-6 (relative viscosity in dry state: 3.2) and chips of low-density polyethylene were blended in a ratio of 50:50 by mass and the mixture was subjected to the mixed melt spinning at 280° C. to give sea-island type mixed fibers with nylon-6 as the island component and polyethylene as the sea component (the number of islands being about 300). Then, cotton-like short fibers having a single fiber fineness of 4 decitex and a fiber length of 51 mm were produced by wet heat stretching, mechanical crimping, oiling and cutting of the mixed fibers.

(2) The cotton-like short fibers obtained as mentioned above under (1) were opened on a card and made into webs on a cross-lap webber, and an entangled nonwoven fabric was produced by subjecting the webs to three-dimensional entanglement treatment at 1,500 punches/$cm^2$ using a needle punching machine with felt needles.

(3) The entangled nonwoven fabric obtained as mentioned above under (2) was impregnated with a solution in dimethylformamide (DMF) of a polyurethane [polyurethane formed by using a polymer diol component composed of poly(3-methyl-1,5-pentane adipate) and polyethylene glycol and having a number average molecular weight of 2,000, 4,4'-diphenylmethanediisocyanate and 1,4-butanediol]. Then, the polyurethane was wet-coagulated in a porous state in a mixed bath composed of DMF and water to thereby replace the DMF within the sheet with water. Thereafter, the polyethylene in the sea-island type mixed fibers was further removed by extraction in a toluene bath at 90° C. to form ultrafine fibers made of nylon-6. Then, the toluene in the sheet was replaced with water, and the sheet was dried in a pin tenter drier. The thus-produced sheet-like substrate had a basis weight of 420 g/$m^2$, a thickness of 1.2 mm and a fiber:polyurethane ratio of 65:35 by mass. In the thus-obtained sheet-like substrate, the ultrafine fibers made of nylon-6 and the polyurethane were substantially free of adhesion to each other and the degree of freedom of the ultrafine fibers to move was thus high.

(4) The sheet-like substrate obtained as mentioned above under (3) was sliced into two in the direction of thickness and each slice was adjusted to a thickness of 0.5 mm and at the same time a nap made of ultrafine nylon-6 fibers was formed on each side by buffing on both sides with a #400 sandpaper. The ultrafine fibers constituting the entangled nonwoven fabric portion and the nap of this napped sheet had a single fiber fineness of 0.006 decitex.

(5) The napped sheet obtained as mentioned above under (4) was subjected to dyeing treatment under the dyeing conditions shown below using a wince dyeing machine, then dried in a pin tenter drier and further subjected to staking treatment and trimming treatment. A brown napped leather-like sheet material having a very good suede-like appearance and a mean nap length of 0.25 mm (basis weight=182 g/$m^2$) was thus produced.

[Dyeing Conditions]

"Ranyl Brown GR" (trade name; product by Sumitomo Chemical Company, Limited) (dye) 4% owf "Levelan NKD" (trade name; product by Marubishi Oil Chemical Co., Ltd.) (dyeing auxiliary) 2 g/liter

| | |
|---|---|
| Dyeing temperature | 90° C. |
| Liquor ratio | 1:20 |

(6) The napped leather-like sheet material obtained as mentioned above under (5) was measured for breaking tenacity and tearing strength by the method mentioned above and evaluated for surface touch and flexibility by the methods mentioned above. The results were as shown below in Table 1.

EXAMPLE 2

[Example of Production of a Napped Leather-like Sheet Material] (Prior Art Example)

(1) Chips of nylon-6 (relative viscosity in dry state: 2.4) and chips of low-density polyethylene were melted separately and joined together at the spinneret portion in a mixing ratio of 65:35 by mass and subjected to composite melt spinning at 270° C. to give sea-island type composite fibers with nylon-6 as the island component and polyethylene as the sea component (the number of islands being about 50). Then, cotton-like short fibers having a single fiber fineness of 4 decitex and a fiber length of 51 mm were produced by wet heat stretching, mechanical crimping, oiling and cutting of the composite fibers.

(2) Using the cotton-like short fibers obtained as mentioned above under (1), an entangled nonwoven fabric was produced in the same manner as in (2) in Example 1.

(3) The entangled nonwoven fabric obtained as mentioned above under (2) was immersed in a 20% aqueous solution of poly(vinyl alcohol) to thereby cause the poly(vinyl alcohol) to adhere to the fiber surface and, then, the polyethylene was removed by extraction with perclene to thereby form ultrafine nylon-6 fibers.

(4) The ultrafine fibers formed entangled nonwoven fabric obtained as mentioned above under (3) was impregnated with the same polyurethane solution in DMF as used in Example 1. Then, the polyurethane was wet-coagulated in a porous state in a mixed bath composed of DMF and water to thereby replace the DMF within the sheet with water and at the same time remove the poly(vinyl alcohol) adhering to the fiber surface by dissolution in water. Thereafter, the sheet was dried in a pin tenter drier. The thus-produced sheet-like substrate had a basis weight of 460 g/$m^2$, a thickness of 1.25 mm and a fiber:polyurethane ratio of 70:30 by mass. In the thus-obtained sheet-like substrate, the ultrafine fiber bundles made of nylon-6 were substantially free from adhesion to the polyurethane and the degree of freedom of the ultrafine fiber bundles to move was thus high.

(5) The sheet-like substrate obtained as mentioned above under (4) was sliced into two in the direction of thickness and each slice was adjusted to a thickness of 0.5 mm and at the same time a nap made of ultrafine nylon-6 fibers was formed on each side by buffing on both sides with a #400 sandpaper. The ultrafine fibers constituting the entangled nonwoven fabric portion and the nap of this napped sheet had a single fiber fineness of 0.05 decitex.

(6) The napped sheet obtained as mentioned above under (5) was subjected to dyeing treatment under the same dyeing conditions as in Example 1, then dried in a pin tenter drier and further subjected to staking treatment and trimming treatment. A brown napped leather-like sheet material having a very good suede-like appearance and a mean nap length of 0.5 mm (basis weight=185 g/$m^2$) was thus produced.

(7) The napped leather-like sheet material obtained as mentioned above under (6) was measured for breaking tenacity and tearing strength by the method mentioned above and evaluated for surface touch and flexibility by the methods mentioned above. The results were as shown below in Table 1.

EXAMPLE 3

Example (1) A treatment liquid for napped leather-like sheet materials was prepared in advance by mixing up 5 parts of a water-soluble partial hydrolyzate of silk fibroin ["Silk Peptide" (trade name; product by Kanebo, Ltd.)], 20 parts of a polyamide type softening agent ["Racset K-150" (trade name; product by Rakuto Kasei Industrial Co., Ltd.)] and 75 parts of water.

(2) A dilution was prepared by diluting 15 g of the silk protein substance- and softening agent-containing treatment liquid prepared as mentioned above under (1) with water to make 100 g.

(3) The dilution prepared as mentioned above under (2) was applied to both sides of the napped leather-like sheet material obtained as mentioned above in Example 1 by the gravure printing technique to a coating weight of about 15 g/m$^2$ on each side and then dried in a warm air drier at 60° C. for 5 minutes to provide the surface portion of each napped face of the napped leather-like sheet material with the silk protein substance and softening agent (basis weight of the napped leather-like sheet material after provision=about 184 g/m$^2$, amount of the silk protein substance provided=about 0.2 g/m$^2$, amount of the softening agent provided=about 0.4 g/m$^2$).

The thus-obtained napped leather-like sheet material was measured for breaking tenacity and tearing strength by the method mentioned above and evaluated for surface touch and flexibility by the methods mentioned above. The results were as shown below in Table 1.

(4) Separately, 5 g of a red dye was dissolved in 100 g of the dilution prepared as mentioned above under (2), and the solution was applied to the napped faces in the same manner as mentioned above under (3) by the gravure printing technique, followed by warm air drying at 60° C. The thus-obtained napped leather-like sheet material was cut in the direction of thickness and the section was observed under an optical microscope. The both surfaces of the napped leather-like sheet material were colored red to the depth of about 0.15 mm from each top surface, the deeper inside remaining uncolored. This result confirms that, in the napped leather-like sheet material obtained in this Example 3, the surface portion of the napped leather-like sheet material was selectively provided with the silk protein substance and softening agent.

EXAMPLE 4

Example (1) The same dilution (diluted treatment liquid containing the silk protein substance and softening agent) as prepared in Example 3 (2) was applied to both sides of the napped leather-like sheet material obtained as mentioned above in Example 2 by the gravure printing technique to a coating weight of about 15 g/m$^2$ on each side and then dried in a warm air drier at 60° C. for 5 minutes to provide the surface portion of each napped face of the napped leather-like sheet material with the silk protein substance and softening agent (basis weight of the napped leather-like sheet material after provision=about 186 g/m$^2$, amount of the silk protein substance provided=about 0.2 g/m$^2$, amount of the softening agent provided=about 0.4 g/m$^2$).

The thus-obtained napped leather-like sheet material was measured for breaking tenacity and tearing strength by the method mentioned above and evaluated for surface touch and flexibility by the methods mentioned above. The results were as shown below in Table 1.

(2) Separately, 5 g of a red dye was dissolved in 100 g of the dilution used in (1), and the solution was applied to the napped faces in the same manner as mentioned above under (1) by the gravure printing technique, followed by warm air drying at 60° C. The thus-obtained napped leather-like sheet material was cut in the direction of thickness and the section was observed under an optical microscope. The both surfaces of the napped leather-like sheet material were colored red to the depth of about 0.16 mm from each top surface, the deeper inside remaining uncolored. This result confirms that, in the napped leather-like sheet material obtained in this Example 4, the surface portion of the napped leather-like sheet material was selectively provided with the silk protein substance and softening agent.

EXAMPLE 5

Example (1) A treatment liquid for napped leather-like sheet materials was prepared in advance by mixing up 10 parts of a water-soluble partial hydrolyzate of silk fibroin ["Silk Peptide" (trade name; product by Kanebo, Ltd.)], 15 parts of an amino-modified silicone type softening agent ["Nicca Silicone AM-204" (trade name; product by NICCA CHEMICAL CO., LTD.)] and 75 parts of water.

(2) A dilution was prepared by diluting 15 g of the silk protein substance- and softening agent-containing treatment liquid prepared as mentioned above under (1) with water to make 100 g.

(3) The dilution prepared as mentioned above under (2) was applied to both sides of the napped leather-like sheet material obtained as mentioned above in Example 1 by the gravure printing technique to a coating weight of about 15 g/m$^2$ on each side and then dried in a warm air drier at 60° C. for 5 minutes to provide the surface portion of each napped face of the napped leather-like sheet material with the silk protein substance and softening agent (basis weight of the napped leather-like sheet material after provision=about 184 g/m$^2$, amount of the silk protein substance provided=about 0.4 g/m$^2$, amount of the softening agent provided=about 0.3 g/m$^2$).

The thus-obtained napped leather-like sheet material was measured for breaking tenacity and tearing strength by the method mentioned above and evaluated for surface touch and flexibility by the methods mentioned above. The results were as shown below in Table 1.

EXAMPLE 6

Comparative Example (1) A dilution was prepared by diluting 2 g of a water-soluble partial hydrolyzate of silk fibroin ["Silk Peptide" (trade name; product by Kanebo, Ltd.)] with water to make 100 g.

(2) The dilution prepared as mentioned above under (1) was applied to both sides of the napped leather-like sheet material obtained as mentioned above in Example 1 by the gravure printing technique to a coating weight of about 15 g/m$^2$ on each side and then dried in a warm air drier at 60° C. for 5 minutes to provide the surface portion of each napped face of the napped leather-like sheet material with the silk protein substance (basis weight of the napped leather-like sheet material after provision=about 184 g/m$^2$, amount of the silk protein substance provided=about 0.6 g/m$^2$).

The thus-obtained napped leather-like sheet material was measured for breaking tenacity and tearing strength by the method mentioned above and evaluated for surface touch and flexibility by the methods mentioned above. The results were as shown below in Table 1.

EXAMPLE 7

Comparative Example (1) A dilution was prepared by mixing up 20 parts of a polyamide type softening agent ["Racset K-150" (trade name; product by Rakuto Kasei Industrial Co., Ltd.)] and 80 parts of water.

(2) The dilution prepared as mentioned above under (1) was applied to both sides of the napped leather-like sheet material obtained as mentioned above in Example 1 by the gravure printing technique to a coating weight of about 15 g/m$^2$ on each side and then dried in a warm air drier at 60° C. for 5 minutes to provide the surface portion of each napped face of the napped leather-like sheet material with the polyamide type softening agent (basis weight of the napped leather-like sheet material after provision=about 184 g/m$^2$ , amount of the polyamide type softening agent provided=about 0.4 g/m$^2$).

The thus-obtained napped leather-like sheet material was measured for breaking tenacity and tearing strength by the method mentioned above and evaluated for surface touch and flexibility by the methods mentioned above. The results were as shown below in Table 1.

EXAMPLE 8

Reference Example (1) A diluted treatment liquid (dilution) containing the silk protein substance and softening agent was prepared by diluting 15 g of the same treatment liquid as prepared in Example 3 (1) with water to make 100 g.

(2) The napped leather-like sheet material produced in Example 1 was immersed in the treatment liquid (dilution) prepared as mentioned above under (1) and, after sufficient penetration, squeezed by means of a mangle to thereby provide the napped leather-like sheet material with a 60% by mass, relative to the mass of the sheet material, of the treatment liquid by impregnation. This was dried in a warm air drier at 60° C. for 10 minutes. A napped leather-like sheet material provided with the silk protein substance and softening substance by impregnation was thus produced (basis weight of the napped leather-like sheet material after provision=about 187 g/m$^2$, amount of the silk protein substance provided= about 0.8 g/m$^2$, amount of the softening agent provided= about 1.4 g/m$^2$). The thus-obtained napped leather-like sheet material was measured for breaking tenacity and tearing strength by the method mentioned above and evaluated for surface touch and flexibility by the methods mentioned above. The results were as shown below in Table 1.

(3) Separately, 5 g of a red dye was dissolved in 100 g of the treatment liquid (dilution) used in (2), and the solution was allowed to penetrate into the napped leather-like sheet material produced in Example 1 in the same manner as mentioned above under (2), followed by warm air drying at 60° C. The thus-obtained napped leather-like sheet material was cut in the direction of thickness and the section was observed under an optical microscope. The whole section was colored red from both surfaces of the napped leather-like sheet material to the middle portion thereof.

EXAMPLE 9

Reference Example (1) A diluted treatment liquid (dilution) containing the silk protein substance and softening agent was prepared by dilution 15 g of the same treatment liquid as prepared in Example 3 (1) with water to make 100 g.

(2) The napped leather-like sheet material produced in Example 2 was immersed in the treatment liquid (dilution) prepared as mentioned above under (1) and, after sufficient penetration, squeezed by means of a mangle to thereby provide the napped leather-like sheet material with a 60% by mass, relative to the mass of the sheet material, of the treatment liquid by impregnation. This was dried in a warm air drier at 60° C. for 10 minutes. A napped leather-like sheet material provided with the silk protein substance and softening substance by impregnation was thus produced (basis weight of the napped leather-like sheet material after provision=about 188 g/m$^2$, amount of the silk protein substance provided= about 0.8 g/m$^2$, amount of the softening agent provided= about 1.5 g/m$^2$). The thus-obtained napped leather-like sheet material was measured for breaking tenacity and tearing strength by the method mentioned above and evaluated for surface touch and flexibility by the methods mentioned above. The results were as shown below in Table 1.

(3) Separately, 5 g of a red dye was dissolved in 100 g of the treatment liquid (dilution) used in (2), and the solution was allowed to penetrate into the napped leather-like sheet material produced in Example 2 in the same manner as mentioned above under (2), followed by warm air drying at 60° C. The thus-obtained napped leather-like sheet material was cut in the direction of thickness and the section was observed under an optical microscope. The whole section was colored red from both surfaces of the napped leather-like sheet material to the middle portion thereof.

TABLE 1

| Example | Surface touch | Flexibility | Breaking tenacity (length × width) (kg/2.5 cm) | Tearing strength (length × width) (kg) |
|---|---|---|---|---|
| Example 1 (prior art example) | X | X | 15.1 × 13.8 | 3.2 × 3.5 |
| Example 2 (prior art example) | X | X | 18.1 × 16.9 | 3.8 × 3.4 |
| Example 3 (example) | ○ | ○ | 14.8 × 13.9 | 2.7 × 2.7 |
| Example 4 (example) | ○ | ○ | 17.8 × 16.5 | 3.2 × 2.7 |
| Example 5 (example) | ○ | ○ | 14.6 × 13.4 | 2.8 × 2.6 |
| Example 6 (comparative example) | ○ | X | 15.0 × 13.8 | 3.1 × 3.3 |
| Example 7 (comparative example) | X | ○ | 14.5 × 13.6 | 2.8 × 2.9 |
| Example 8 (reference example) | ○ | ○ | 8.7 × 5.5 | 4.5 × 3.6 |
| Example 9 (reference example) | ○ | ○ | 8.9 × 7.8 | 4.2 × 3.6 |

From the results of Examples 1 and 2 shown in the above Table 1, it is evident that the napped leather-like sheet materials (prior art napped leather-like sheet materials) of Examples 1 and 2, provided with neither the silk protein substance nor the softening agent, have a good suede-like appearance but are lacking in natural leather suede-like velvety, smooth surface touch and in flexibility suited for clothing use and, thus, they are insufficient in high quality sensation.

On the contrary, the results of Examples 3 to 5 (Examples of the Invention) shown in Table 1 indicate that the napped leather-like sheet materials of Examples 3 to 5, provided with the silk protein substance and softening agent in the surface portion of each napped face thereof, have not only a good suede-like appearance but also a natural leather suede-like velvety, smooth surface touch, flexibility suited for clothing use etc., with appropriately reduced firmness, and, thus, a high quality feel or touch. Moreover, it is seen that there are no decreases in mechanical characteristics and the sheet materials have good mechanical characteristics intrinsic in the napped leather-like sheet materials.

The results of Example 6 (Comparative Example) shown in Table 1 indicate that the napped leather-like sheet material of Example 6, provided with the silk protein substance alone, is excellent in surface touch but lacking in velvety smoothness and in flexibility suited for clothing use etc. The results of Example 7 (Comparative Example) shown in Table 1 show that the napped leather-like sheet material of Example 7, provided with the softening agent alone, has flexibility suited for clothing use etc., but is lacking in surface touch and in velvety smoothness.

Further, the results of Examples 8 and 9 (Reference Examples) shown in Table 1 indicate that the napped leather-like sheet materials of Examples 8 and 9, provided with the silk protein substance and softening agent not only the surface portions thereof but throughout the whole thereof by impregnation, have a good suede-like appearance and a natural leather suede-like velvety, smooth surface touch, flexibility suited for clothing use etc., with appropriately reduced firmness, and, thus, a high quality feel or touch. However, the napped leather-like sheet materials of Examples 8 and 9 show decreases in mechanical characteristics thereof. Further, coats were made using the napped leather-like sheet materials obtained in Prior Art Examples 1 and 2, Examples 3 to 5 and Comparative Examples 6 and 7. The coats made by using the materials of Examples 3 to 5 each had a good suede-like appearance and at the same time had a natural leather suede-like velvety and smooth surface touch, and flexibility with appropriately reduced firmness, and thus gave a high quality sensation. The coats made by using the materials of Prior Art Examples 1 and 2 each had a good suede-like appearance but each was lacking in velvety, smooth touch and in flexibility. The coat made by using the material of Comparative Example 6 had a good suede-like appearance and a smooth touch but was lacking in velvety feel and in flexibility. The coat made by using the material of Comparative Example 7 had a good suede-like appearance and flexibility suited for clothing use etc. but was lacking in surface touch and velvety feel.

Effects of the Invention

The invention thus provides a napped leather-like sheet material having a natural leather suede-like good appearance, a natural leather suede-like or nubuck-like velvety, smooth surface touch, flexibility with appropriately reduced firmness, and a good, high quality feel or touch.

According to the invention, the surface portion of the napped leather-like sheet material is selectively provided with the silk protein substance and softening agent, so that the napped leather-like sheet material can manifest the above-mentioned good, high quality feel or touch, without impairing the mechanical characteristics, such as breaking tenacity and tearing strength, intrinsic in the napped leather-like sheet material.

The leather-like sheet material of the invention can judiciously be used in various fields of use where it comes into contact with the human skin, such as clothing, gloves, seats, bags, footwear and car interiors, making the best use of its excellent characteristics mentioned above.

The disclosure in priority application, JP 357597/2000, filed Nov. 24, 2000, is hereby incorporated by reference.

What is claimed is:

1. A napped artificial leather sheet material wherein (1) at least one silk protein substance selected from the group consisting of silk proteins and partial hydrolyzates of silk proteins and (2) a softening agent has been applied to a surface portion of one or both napped faces thereof.

2. The napped artificial leather sheet material as claimed in claim 1, wherein a portion below the surface portion, free of the silk protein substance and softening agent, occurs as a layer in the vicinity of the middle in a direction of thickness of the sheet material.

3. The napped artificial leather sheet material as claimed in claim 1, wherein the silk protein substance comprises at least one substance selected from the group consisting of silk fibroin solubilized in water and water-soluble partial hydrolyzates of silk fibroin.

4. The napped artificial leather sheet material as claimed in claim 2, wherein the silk protein substance comprises at least one substance selected from the group consisting of silk fibroin solubilized in water and water-soluble partial hydrolyzates of silk fibroin.

5. The napped artificial leather sheet material as claimed in claim 1, wherein the ratio by mass of the silk protein substance to the softening agent, applied to the napped artificial leather sheet material, is 20:80 to 70:30.

6. The napped artificial leather sheet material as claimed in claim 2, wherein the ratio by mass of the silk protein substance to the softening agent, applied to the napped artificial leather sheet material, is 20:80 to 70:30.

7. The napped artificial leather sheet material as claimed in claim 3, wherein the ratio by mass of the silk protein substance to the softening agent, applied to the napped artificial leather sheet material, is 20:80 to 70:30.

8. The napped artificial leather sheet material as claimed in claim 4, wherein the ratio by mass of the silk protein substance to the softening agent, applied to the napped artificial leather sheet material, is 20:80 to 70:30.

9. The napped artificial leather sheet material as claimed in claim 1, wherein, based on the basis weight (A) ($g/m^2$) of the napped artificial leather sheet material before being provided with the silk protein substance and softening agent, the silk protein substance is applied in an amount of 0.0005 A to 0.025 A ($g/m^2$) and the softening agent in an amount of 0.001 A to 0.1 A ($g/m^2$).

10. The napped artificial leather sheet material as claimed in claim 1, wherein the nap-forming fibers comprise ultrafine fibers, which ultrafine fibers comprise entangled nonwoven fabric containing an elastomer therein.

11. The napped artificial leather sheet material as claimed in claim 10, wherein the ultrafine fibers are obtained by removing a sea component from fibers having a sea-island structure as obtained by the mixed spinning or composite spinning technique and wherein the ultrafine fibers are substantially free from adhesion to the elastomer in the napped artificial leather sheet material.

12. The napped artificial leather sheet material as claimed in claim 10, wherein the ultrafine fibers have a single fiber fineness of not more than 0.5 decitex.

13. The napped artificial leather sheet material as claimed in claim 10, wherein the ratio by mass of the ultrafine fibers to the elastomer is 30/70 to 95/5.

14. The napped artificial leather sheet material as claimed in claim 1, wherein the softening agent is a silicone softening agent.

15. The napped artificial leather sheet material as claimed in claim 1, wherein the softening agent is a polyamide softening agent.

16. A method of producing napped artificial leather sheet materials which comprises applying (a) a liquid containing (1) a silk protein substance selected from the group consisting of silk proteins and partial hydrolyzates of silk proteins, and (2) a softening agent, or (b) applying a liquid containing said silk protein substance and a liquid containing a softening agent simultaneously or separately, to the napped surface (s) of a napped artificial leather sheet material comprising an entangled nonwoven fabric comprising ultrafine fibers and an elastomer contained therein and having a nap made of ultrafine fibers on one or both sides thereof.

17. The method of producing napped artificial leather sheet materials as claimed in claim 16, wherein the applying is carried out by a gravure printing technique or spraying technique.

18. An article of clothing produced from a napped artificial leather sheet material as claimed in claim 1.

19. An article of clothing produced from a napped artificial leather sheet material as claimed in claim 2.

20. An article of clothing produced from a napped artificial leather sheet material as claimed in claim 3.

* * * * *